US005633556A

United States Patent [19]

Fujina et al.

[11] Patent Number: 5,633,556

[45] Date of Patent: May 27, 1997

[54] DISCHARGE LAMP OF THE WATER COOLED TYPE

[75] Inventors: Kyosuke Fujina, Hyogo-ken; Shoichi Mayama, Himeji; Katsuoki Miyasu, Hyogo-ken, all of Japan

[73] Assignee: Ushiodenki Kabushiki Kaisha, Tokyo, Japan

[21] Appl. No.: 506,853

[22] Filed: Jul. 25, 1995

[30] Foreign Application Priority Data

Jul. 29, 1994 [JP] Japan ..... 6-196207

[51] Int. Cl.[6] ..... H01J 1/02

[52] U.S. Cl. ..... 313/32; 313/30; 313/35; 313/39; 313/631; 313/352

[58] Field of Search ..... 313/30, 32, 35, 313/39, 631, 632, 352, 354

[56] References Cited

U.S. PATENT DOCUMENTS

| | | | |
|---|---|---|---|
| 3,043,972 | 7/1962 | Laszlo | 313/32 |
| 3,311,769 | 3/1967 | Schmidtlein | 313/35 |
| 3,412,275 | 11/1968 | Thouret | 313/32 |
| 3,636,401 | 1/1972 | Cortorillo et al. | 313/32 |

*Primary Examiner*—Nimeshkumar Patel
*Attorney, Agent, or Firm*—Sixbey, Friedman, Leedom & Ferguson, P.C.; David S. Safran

[57] ABSTRACT

A discharge lamp provided with an anode of the water cooled type achieves advantageous cooling directly connected a tungsten tip piece to a tip of a body element of the anode that is formed of copper has a water cooling arrangement therein, by having a maximum outer diameter of the tungsten tip piece about equal to an outer diameter D (mm) of the body element, and by maintaining the relationship between the outer diameter D and the thickness of the tungsten tip piece L of: $0.2 \leqq L/D \leqq 0.5$. In accordance with a preferred embodiment, the tungsten tip piece is directly connected to a tip of a cylindrical body element inside of which a cooling water feed tube is arranged extending coaxially to the body element, and in which cooling water is fed from a base of this cooling water feed tube, along the cooling water feed tube, strikes an inner side of the tip end of the body element and finally is conveyed through a gap between an inner side of the body element and an outer side of the cooling water feed tube which serves as a cooling water drainage duct. Preferably, the tungsten tip piece has the shape of a truncated cone whose maximum outer diameter is about equal to the outer diameter D (mm) of the body element and a thickness in a lengthwise direction of the body element.

4 Claims, 2 Drawing Sheets

Fig. 4

| LIGHTING DURATION / EMBODIMENT | 250 HOURS | 500 HOURS | 750 HOURS | 1000 HOURS |
|---|---|---|---|---|
| $L_1$/ D=0.1 | NO FISSURES NO CORROSION | FISSURES PRESENT NO CORROSION | ——— | ——— |
| $L_2$/ D=0.2 | NO FISSURES NO CORROSION | NO FISSURES NO CORROSION | NO FISSURES NO CORROSION | NO FISSURES NO CORROSION |
| $L_3$/ D=0.4 | NO FISSURES NO CORROSION | NO FISSURES NO CORROSION | NO FISSURES NO CORROSION | NO FISSURES NO CORROSION |
| $L_4$/ D=0.5 | NO FISSURES NO CORROSION | NO FISSURES NO CORROSION | NO FISSURES NO CORROSION | NO FISSURES NO CORROSION |
| $L_5$/ D=0.6 | NO FISSURES NO CORROSION | NO FISSURES NO CORROSION | NO FISSURES NO CORROSION | NO FISSURES NO CORROSION |

Fig. 5

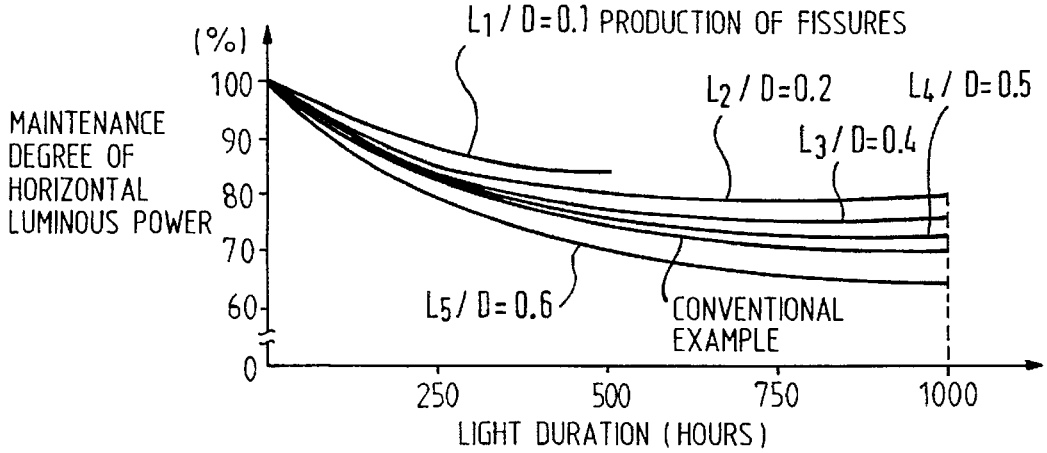

DISCHARGE LAMP OF THE WATER COOLED TYPE

BACKGROUND OF THE INVENTION

1. Field of the Invention

The invention relates to a discharge lamp using an anode of the water-cooled type.

2. Description of Related Art

For a discharge lamp with high output power, for example, for a light source of an "artificial sun" device, such as in the development of the universe and in research of the universe or the like, generally an anode of the water-cooled type is used. In such a lamp with a high output power, an anode and a cathode are placed opposite one another inside a bulb made of quartz glass and, at least inside the anode, a cooling water duct is made. This duct is placed inside an element that is a main part of the anode. At a tip of this element, tungsten is attached to receive the arc discharge produced between the electrodes, and between them a brazing filler metal is used as a connecting material.

Materials of varying type are used for such an anode. For the element, copper or nickel with good electrical conductivity and good heat conductivity is used, and for the brazing filler metal, protective layers of nickel are used.

It is true that such a water cooling arrangement is required for an anode whose temperature is slightly raised. But, it is possible for the cathode also to have such an arrangement. Such water-cooled electrodes are used, for example, for a lamp with a high output power of 10 KW to 30 KW. Further, in the case where the cathode is also has a water cooling arrangement, the tungsten can be mixed with thorium.

The conventional water-cooled anode has the following drawbacks:

(1) The brazing filler metal used to connect the element with the tungsten on its tip is, with respect to heat conductivity, not always sufficient. The heat produced in the tungsten at the tip is, therefore, not conducted into the element to a sufficient extent. The heat produced in the tungsten thus vaporizes the above-described tungsten material, which then adheres to the inside of the luminous discharge tube, producing a blackening that contributes to a diminishing of the light emission.

(2) Fissures appear in the tungsten at the tip when the temperature increases. If the fissures occur topically, the temperature increases still more, which causes not only an acceleration of the vaporization of the above-described tungsten, but also causes the arc discharge to become unstable.

(3) Corrosion progresses from the cooling water duct inside the element toward the tungsten at the tip, and needle-fine holes penetrate through the element and the tungsten on its tip. This produces the drawback that, through these holes, the cooling water gets into the interior space of the luminous discharge tube, or the like.

SUMMARY OF THE PRESENT INVENTION

The primary object of the invention is, thus, to achieve an advantageous cooling in a discharge lamp provided with an anode of the water cooled type.

This object is achieved according to the invention in that a discharge lamp has an anode in which tungsten is directly connected to a tip of an element made of copper, whose interior space has a water cooling arrangement, in that a maximum outer diameter of the tungsten tip is about equal to an outer diameter D (mm) of the above-described element, and in that the condition $0.2 \leqq L/D \leqq 0.5$ is maintained, where L is the thickness of the tungsten tip in millimeters (mm).

The object of the invention is further achieved specifically in that an anode is attached in which tungsten is directly connected to a tip of a cylindrical element consisting of copper to receive an arc discharge produced between electrodes, in which a feed tube for cooling water is placed inside the cylindrical element that extends coaxially to the element, and in which cooling water fed from a base of this cooling water feed tube is conveyed along the cooling water feed tube, strikes an inner side of the tip of the cylindrical element, and finally, is conveyed through a gap between an inner side of the cylindrical element and an outer side of the cooling water feed tube that serves as a cooling water drainage duct up to the base of the cylindrical element. Furthermore, the tungsten tip has approximately the shape of a truncated cone whose maximum outer diameter is about equal to an outer diameter D (mm) of the cylindrical element, and the condition $0.2 \leqq L/D \leqq 0.5$ is maintained, where the thickness of the tungsten in a lengthwise direction of the cylindrical element is L (mm).

The object of the invention is further advantageously achieved in that an insulating film made of copper(l) oxide or silicon dioxide is attached on the inner side of the tip of the cylindrical element.

According to the invention, the following advantages are achieved:

(1) Because of the direct connection of the element and the tungsten to one another, without a brazing filler metal of poor heat conductivity, the tungsten can be advantageously cooled. Thus, the temperature increase of the tungsten and, further, the fissuring of the tungsten can be prevented.

(2) By fixing the thickness of the tungsten in the lengthwise direction of the element, there is no problem in the connection, even if a direct connection without is produced without using the brazing filler metal.

(3) The insulating film attached on the inner side of the tip of the element can prevent corrosion inside the element.

These and further objects, features and advantages of the present invention will become apparent from the following description when taken in connection with the accompanying drawings which, for purposes of illustration only, show several embodiments in accordance with the present invention.

BRIEF DESCRIPTIONS OF THE DRAWINGS

FIG. 4 is a chart representation of situations in which fissures as well as corrosion are produced for various thicknesses of a tungsten tip that is bonded to an element of the anode according to the invention and for various periods of illumination; and FIG. 5 is a graphic representation of the degree of luminosity maintenance for various thicknesses of the tungsten tip that is glued to an element of the anode according to the invention as a function of hours of illumination.

DETAILED DESCRIPTION OF THE PREFERRED EMBODIMENT

Figure 1:
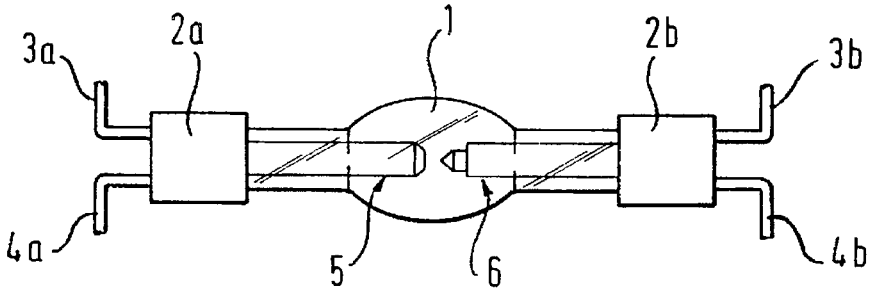
FIG. 1 is a diagrammatic representation of a discharge lamp of the water cooled type according to the invention.

FIG. 1 diagrammatically shows an overall view of a water-cooled discharge lamp. In the representation, a reference symbol 1 designates a luminous discharge tube. Bases 2*a* and 2*b* are placed on opposite ends of the luminous discharge tube 1, hermetically sealing an interior space of luminous discharge tube 1. A water feed tube 3*a* for cooling water is connected by base 2*a* to an anode 5 and further by base 2*a* to a drainage tube 4*a*. In the same way, a water feed tube 3*b* is connected by base 2*b* to a cathode 6 and, also to a drainage tube 4*b*.

The shortest distance between anode 5 and cathode 6, i.e., a discharge gap, is about 8 mm. Xenon gas at a pressure of 4,400 hPa at a room temperature of 25° C. is encapsulated inside of the luminous discharge tube 1. This lamp is operated, for example, with a current of 400 amp. Å and a voltage of 37 V.

Figure 2:
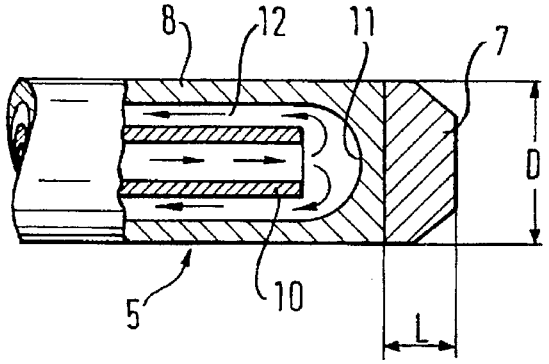
FIG. 2 is a diagrammatic representation of the anode arrangement according to the invention.

FIG. 2 is a diagrammatic representation in cross section of the anode. A tip piece made of tungsten 7 is fixed on a tip of an body element 8 formed of copper, without any brazing filler metal or the like being provided between them as a connecting material. A cooling water feed tube 10 is coaxially disposed within the body element 8. -Cooling water fed from water feed tube 3*a* is conveyed along feed tube 10 from a base up to the tip, strikes an inner side 11 of the tip of body element 8, then flows through a gap 12 between an inner side of body element 8 and an outer side of the feed tube 10. Gap 12 serves as a drainage duct through which the water flows back to the base of body element 8, and is conveyed toward the outside by drainage tube 4*a* of the lamp. Body element 8 has, for example, a cylindrical shape with an outer diameter of 25 mm. Feed tube 10 is formed, for example, of copper and has a cylindrical shape with an outer diameter of 14 mm. The inner side 11 of the tip of body element 8 is provided with an insulating film of copper(I) oxide or silicon dioxide.

Without using a brazing filler metal or the like, tungsten with approximately the shape of a truncated cone is directly connected to the tip of body element 8, and its outer diameter is about equal to the outer diameter of body element 8. This direct connection is achieved by a pouring procedure in a vacuum, and the connected surface area is about 100%. With such a direct connection, the tungsten can be cooled with a higher efficiency compared to using the brazing filler metal. Thus, the temperature of the tungsten can be lowered, the vaporization can be reduced, and thus, blackening of the luminous discharge tube as a result of the adhesion of the tungsten can be reduced.

Figure 3:
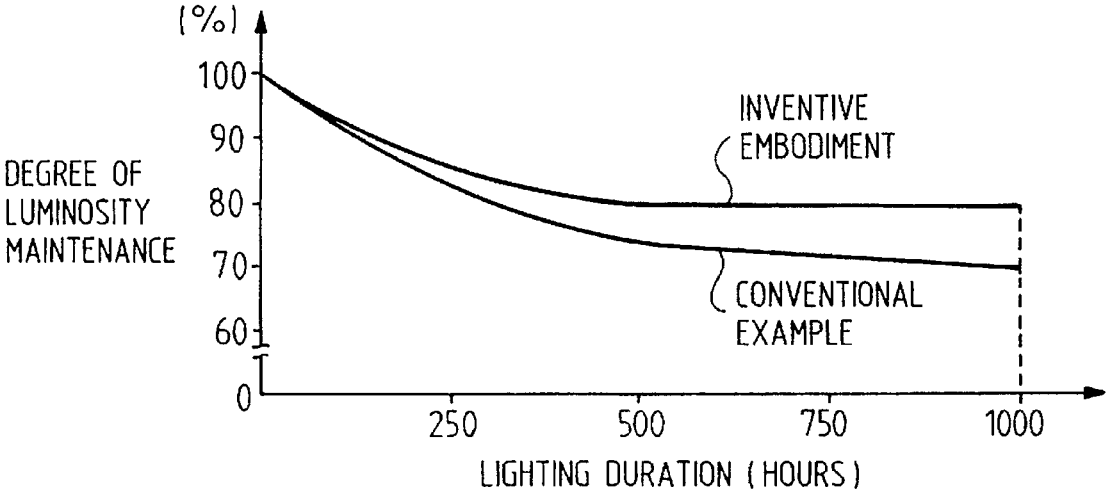
FIG. 3 is a graphic representation of the degree of luminosity maintenance of the discharge lamp of the water cooling type according to the invention as compared to a conventional example.

Below, based on FIG. 3, the extent to which light intensity of the lamp according to the invention diminishes with usage as compared to a conventional lamp is described. The term "lamp according to the invention" is to be understood as any lamp in which the body element 8 and the tungsten tip piece 7 are directly connected to one another, while the term "conventional lamp" is to be understood to mean a lamp in which a connection is performed using a brazing filler metal. Aside from this point, the other features of the tested lamps are completely identical.

The term "degree of luminosity maintenance" is to be understood to be a relationship with respect to a starting value where a value of horizontal luminosity (luminosity in a direction perpendicular to a discharge direction) at startup of a lighting operation of the lamp is designated as 100%, the horizontal luminosity having been measured hourly after the startup of the lighting operation. It can be seen from the figure that, in the lamp according to the invention, even after 1,000 hours have passed since the startup of the lighting operation, a degree of luminosity maintenance of about 80% can be maintained, which is 10% higher than for the conventional lamps.

Next, a ratio between the outer diameter and thickness of the tip piece was investigated. Tests were performed with an body element 8 with an outer diameter D of 25 mm, and tungsten lip pieces 7 with an outer diameter D of 25 mm whose thickness L (mm) was changed to produce the L/D ratios indicated in the table of FIG. 4 (where $L_1$=2.5 mm; $L_2$=5.0 mm; $L_3$=10.0 mm; $L_4$=12.5 mm; and $L_5$=15.0 mm). Also, an insulating film was placed inside the lip of the body element 8 for each lamp.

Five lamps of the water cooling type were produced in the way described above and each was operated with a lighting duration of 1,000, and they were observed to see if a fissuring situation in the anode tip arose and if corrosion of the inner side of the anode tip was or was not present.

FIG. 4 shows the results. Only in the case where a thickness $L_1$ of the tungsten was 2.5 mm and $L_1/D$ was 0.1 did fissures form in the tungsten. In the other tests, there was no fissure formation. The reason for this, presumably, lies in the fact that, corresponding to an increase of thickness L of the tungsten, the temperature gradient inside the tungsten is flatter, and as a result, the thermal stress produced by the temperature gradient is reduced.

Further, in no test was corrosion on the inner side of the anode tip confirmed. The reason for this, presumably, lies in the fact that, because of the insulating film, no potential difference is produced between the inner side of the tip, which comes into contact with the cooling water, and the cooling water. Next, the degree of luminosity maintenance of these five lamps was measured after a lighting duration of 1,000 hours. The degree of luminosity maintenance was determined in the same way as is described above. FIG. 5 shows the results. In addition to showing the results for the five lamps of FIG. 4, the degree of luminosity maintenance of conventional lamps is also represented in FIG. 5 for purposes of comparison.

From FIG. 5, it can be seen that the degree of luminosity maintenance of the lamps with an $L_5/D$ of 0.6, after a lighting duration of 1,000 hours, had dropped to less than or equal to 70% of the starting value. The reason for this lies in the fact that the temperature of the tungsten rises and that the tungsten vaporizes if thickness L of the tungsten increases up to about 15 mm.

As described above, it is effective that an insulating film be placed on the inner side of the tip of the body element 8 and that the thickness L of the tungsten tip piece and the diameter D of the body element 8 maintain the relationship: $0.2 \leqq L/D \leqq 0.5$.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. A discharge lamp of the water cooled type, comprising an anode having a body element formed of copper, a tungsten tip piece directly connected to a tip of the body element and a water cooling arrangement within the body element; wherein a maximum outer diameter of the tungsten tip piece is about equal to an outer diameter D (mm) of the body element; and wherein the relationship $0.2 \leqq L/D \leqq 0.5$ is fulfilled, where L is a thickness (mm) of the tungsten tip piece.

2. A discharge lamp of the water cooled type according to claim 1, wherein the body element is a cylindrical element; the water cooling arrangement comprises a cooling water feed tube that extends coaxially within the cylindrical element from a base to a tip end thereof leaving a gap between an outer side of the cooling water feed tube and interior surfaces of the cylindrical element, said gap forming a cooling water discharge duct leading from the tip end of the cylindrical element to the base thereof; wherein the tungsten tip piece has approximately the shape of a truncated cone whose maximum outer diameter is about equal to outer diameter D (mm) and the thickness L is in a lengthwise direction of the cylindrical element.

3. A discharge lamp of the water cooled type according to claim 2, wherein an insulating film made of a material selected from the group consisting of copper (I) oxide and silicon dioxide is provided on an inner side of the tip end of the cylindrical element.

4. A discharge lamp of the water cooled type according to claim 1, wherein an insulating film made of a material selected from the group consisting of copper (I) oxide and silicon dioxide is provided on an inner side of the tip end of the cylindrical element.

* * * * *